United States Patent [19]

Ragland, Jr.

[11] Patent Number: 4,786,840

[45] Date of Patent: Nov. 22, 1988

[54] CATHODE-RAY TUBE HAVING A FACEPLATE PANEL WITH A SUBSTANTIALLY PLANAR PERIPHERY

[75] Inventor: Frank R. Ragland, Jr., Lancaster, Pa.

[73] Assignee: RCA Licensing Corporation, Princeton, N.J.

[21] Appl. No.: 469,774

[22] Filed: Feb. 25, 1983

[51] Int. Cl.[4] ..... H01J 29/86

[52] U.S. Cl. ..... 313/477 R; 220/2.1 A; 358/252; 313/408

[58] Field of Search ..... 313/402, 403, 404, 405, 313/406, 407, 408, 477 R; 220/2.1 A, 2.3 A; 358/252, 250

[56] References Cited

U.S. PATENT DOCUMENTS

| | | | |
|---|---|---|---|
| Re. 27,259 | 12/1971 | Rublack | 313/70 C |
| 1,750,661 | 3/1930 | Bown | 313/477 R |
| 2,728,012 | 8/1952 | Swedlund | 313/478 X |
| 3,931,906 | 1/1976 | Bradu | 425/505 |
| 4,136,300 | 1/1979 | Morrell | 313/403 |

FOREIGN PATENT DOCUMENTS

| | | | |
|---|---|---|---|
| 53-35366 | 4/1978 | Japan | 313/402 |
| 55-28269 | 2/1980 | Japan | 313/477 R |
| 55-139748 | 10/1980 | Japan | 313/477 R |
| 868882 | 9/1981 | U.S.S.R. . | |
| 1130206 | 10/1968 | United Kingdom . | |
| 1144354 | 3/1969 | United Kingdom . | |
| 1358161 | 6/1974 | United Kingdom | 313/477 |

*Primary Examiner*—David K. Moore
*Assistant Examiner*—K. Wieder
*Attorney, Agent, or Firm*—Eugene M. Whitacre; Dennis H. Irlbeck

[57] ABSTRACT

A cathode-ray tube includes a rectangular faceplate which has an exterior surface having curvature along both the minor and major axes. The exterior surface of the faceplate includes a rectangular contour near its periphery which substantially lies in a plane which is perpendicular to the central longitudinal axis of the tube.

1 Claim, 3 Drawing Sheets

CATHODE-RAY TUBE HAVING A FACEPLATE PANEL WITH A SUBSTANTIALLY PLANAR PERIPHERY

This invention relates to cathode-ray tubes (CRT's) and, particularly, to the surface contours of the faceplate panels of such tubes.

BACKGROUND OF THE INVENTION

There are two basic faceplate panel contours utilized commercially for rectangular CRT's of screen sizes greater than about a 9-inch (22.9 cm) diagonal: spherical, and cylindrical. Although flat contours are possible, the added thickness and weight of the faceplate panel required to maintain the same envelope strength are undesirable. Furthermore, if a flat faceplate CRT is a shadow mask color picture tube, the additional weight and complexity of an appropriate shadow mask also are undesirable.

The present invention provides a novel curved faceplate panel contour that is neither spherical nor cylindrical, but that can create an illusion to a viewer of being flat.

SUMMARY OF THE INVENTION

A cathode-ray tube includes a rectangular faceplate which has an exterior surface having curvature along both the minor and major axes. The exterior surface of the faceplate includes a rectangular contour near its periphery which substantially lies in a plane which is perpendicular to the central longitudinal axis of the tube.

DETAILED DESCRIPTION OF THE PREFERRED EMBODIMENTS

Figure 1:
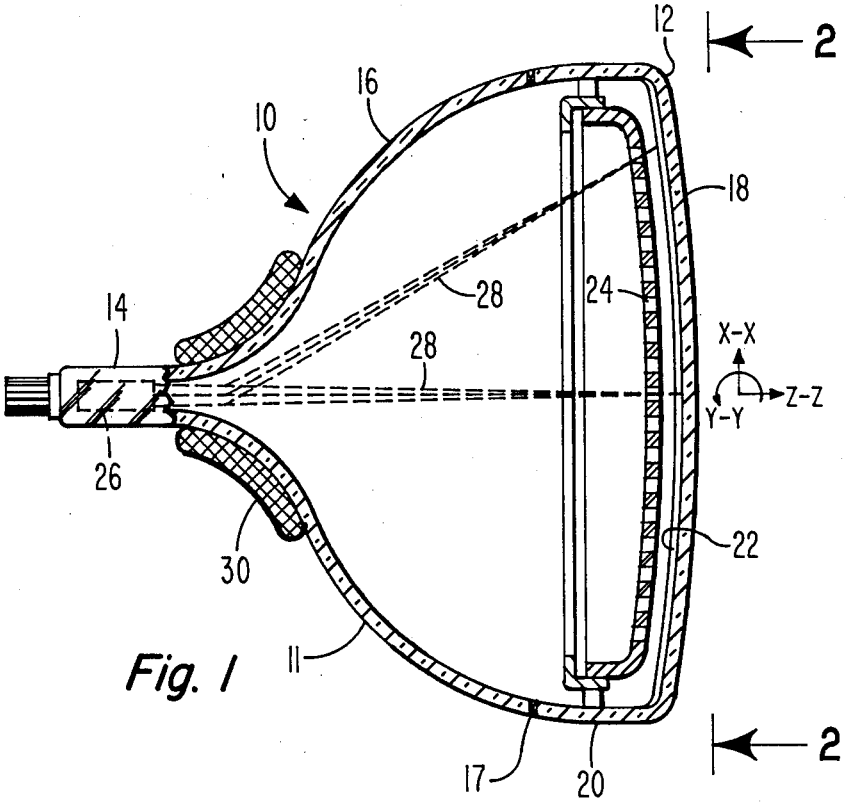
FIG. 1 is a plan view, partly in axial section, of a shadow mask color picture tube in which one embodiment of the present invention is incorporated.

FIG. 1 shows a rectangular cathode-ray tube (CRT), in the form of a color picture tube 10 having a glass envelope 11, comprising a rectangular faceplate panel 12 and a tubular neck 14 connected by a funnel 16. The panel comprises a viewing faceplate 18 and a peripheral flange or sidewall 20, which is sealed to the funnel 16 by a glass frit 17. A rectangular three-color phosphor screen 22 is carried by the inner surface of the faceplate 18. The screen is preferably a line screen, with the phosphor lines extending substantially parallel to the minor axis Y—Y of the tube (normal to the plane of FIG. 1). Alternatively, the screen also can be a dot screen. A multi-apertured color selection electrode or shadow mask 24 is removably mounted within the faceplate panel 12 in predetermined spaced relation to the screen 22. An inline electron gun 26, shown schematically by dotted lines in FIG. 1, is centrally mounted within the neck 14 to generate and direct three electron beams 28 along coplanar convergent paths through the mask 24 to the screen 22. Alternatively, the electron gun also can have a triangular or delta configuration.

The tube 10 of FIG. 1 is designed to be used with an external magnetic deflection yoke, such as the yoke 30 schematically shown surrounding the neck 14 and funnel 16 in the neighborhood of thier junction, for subjecting the three beams 28 to vertical and horizontal magnetic flux, to scan the beams horizontally in the direction of the major axis (X—X) and vertically in the direction of the minor axis (Y—Y), respectively, in a rectangular raster over the screen 22.

Figure 2:
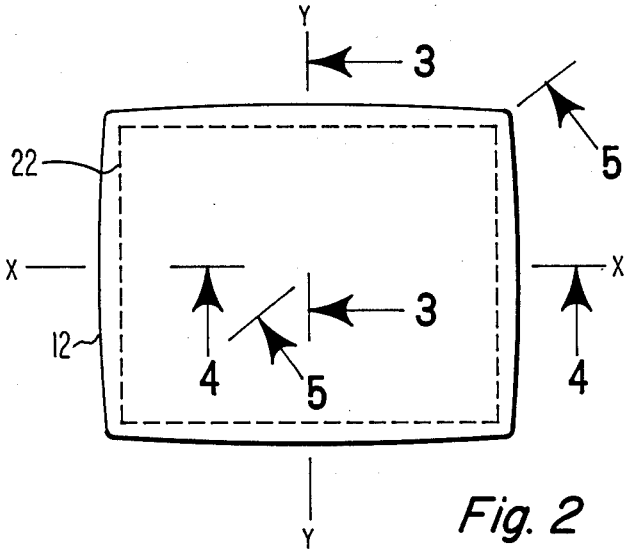
FIG. 2 is a front view of the faceplate panel of the tube of FIG. 1 taken at line 2—2 of FIG. 1.

FIG. 2 shows the front of the faceplate panel 12. The periphery of the panel 12 forms a rectangle with slightly curved sides. The border of the screen 22 is shown with dashed lines in FIG. 2. This border is rectangular.

Figure 5:
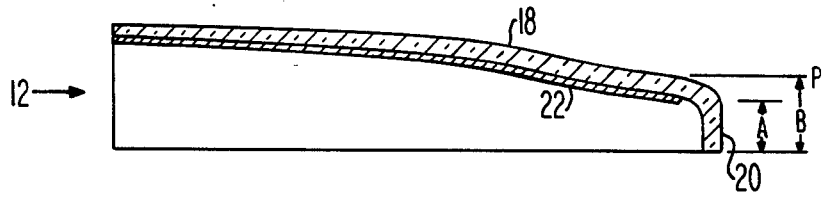
Figure 6:
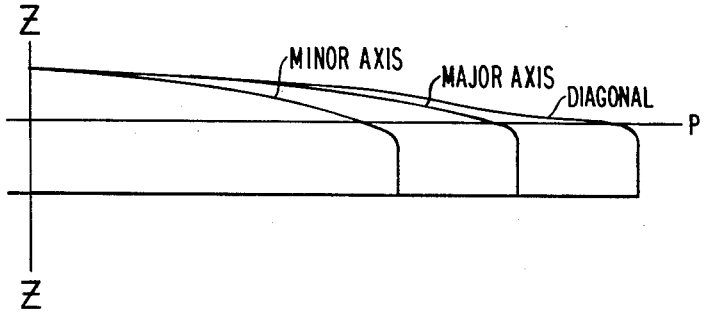
FIG. 6 is a compound view showing the exterior surface contours of the faceplate panel at the cross-sections of FIGS. 3, 4 and 5.

The specific contours along the minor axis (Y—Y), major axis (X—X) and the diagonal are shown in relative contours of the exterior surface of the faceplate panel 12 along the minor axis, major axis and diagonal is shown in FIG. 6. The exterior surface of the faceplate panel 12 is curved along both the major and minor axes, with the curvature along the minor axis being greater than the curvature along the major axis, at least in the center portion of the panel 12. The surface curvature along the diagonal is selected to smooth the transition between the different curvatures along the major and minor axes. In a preferred embodiment, the curvature along the minor axis is at least 4/3 greater than the curvature along the major axis, at least in a central portion of the faceplate. In the preferred embodiment, a contour along the diagonal has at least one sign change of its second derivative going from the faceplate center-to-corner such as shown in FIGS. 5 and 6.

Figure 3:
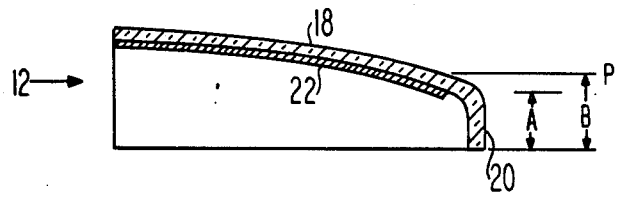
FIGS. 3, 4 and 5 are cross-sections of the faceplate panel of FIG. 2 taken at lines 3—3, 4—4 and 5—5 respectively, of FIG. 2.
Figure 4:
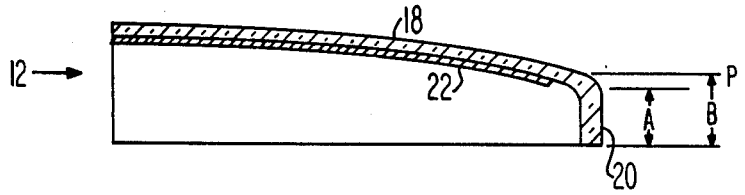

Because of the differing Curvatures along the major and minor axes and along the diagonal, the height A of the panel skirt 20 can be made constant around the periphery of the panel 12, as illustrated in FIGS. 3 to 5. In order to achieve such constant skirt height, it is necessary to properly smooth the faceplate contour between the edge of the screen and the skirt. If such smoothing presents difficulties, skirt height will vary slightly around the tube periphery in a scallop fashion, i.e., it will be slightly higher at the diagonal than at the ends of the major and minor axes. The present invention encompasses both such skirt alternatives.

Because of the differing curvatures along the major and minor axes, the points on the exterior surface of the panel directly opposite the edges of the screen 22 substantially lie all in the same plane P. These substantially planar points, when viewed from the front of the faceplate panel 12, as in FIG. 2, form a contour line on the exterior surface of the panel that is substantially a rectangle superposed on the edges of the screen 22. Therefore, when the novel tube 10 is inserted into a television receiver, a uniform width border mask or bezel can be used around the tube. The edge of such a bezel that contacts the tube at the rectangular contour line also is substantially in the plane P. Since the periphery border of a picture on the tube screen appears to be planar, there is an illusion created that the picture is flat, even though the faceplate panel is curved along both the major and minor axes.

In one tube embodiment, the faceplate panel is formed from two smoothed cylindrical surfaces, the axes of which are perpendicular. The radii of the two cylindrical surfaces are chosen so that, when the two surfaces are made tangent at the center of the panel, there is a plane perpendicular to the Z axis that intersects the surfaces and forms a rectangle at the intercept therewith. The following equation can be used to determine the geometric parameters of the panel surface contour along the major and minor axes:

$$R_1 - \tfrac{1}{2}\sqrt{4R_1^2 - l_1^2} = R_2 - \tfrac{1}{2}\sqrt{4R_2^2 - l_2^2}\ ,$$

where:

$R_1$=radius of curvature along the major (X) axis;

$R_2$=radius of curvature along the minor (Y) axis;

$l_1$=cord length of the panel in the major (X) axis direction; and $l_2$=cord length of the panel in the minor (Y) axis direction.

The actual panel contour is described by segments of circles parallel to the X-Z plane and having radii varying from one value on the X axis to a relatively large value at the ends of the minor axis, and by segments of circles parallel to the Y-Z plane and having radii varying from another value on the Y axis to another relatively large value at the ends of the major axis. The radius on the minor (Y) axis is shorter than the radius on the major (X) axis, wherefore there is greater curvature along the minor axis than along the major axis.

The radii of the circular segments at the ends of the major and minor axes are sufficiently large that, when the faceplate is viewed at normal viewing distances, portions of the faceplate at the edges of the screen appear as straight lines. Such radii could be infinite, whereby the periphery border of the panel would be truly planar, or very long, whereby the sides of the periphery border would bow slightly out of a plane but still be considered to be substantially planar.

The contour of the interior surface of the faceplate 18 of the panel 12 is slightly different from the exterior surface contour. This is because a certain amount of wedging must be added to the faceplate thickness to optimize the strength-to-weight ratio of the faceplate panel, such as shown in FIG. 5. The faceplate 18, therefore, increases in thickness from its center to its edges. In most embodiments, a larger amount of wedging occurs along the minor axis (Y—Y) than along the major axis (X—X). The amount of wedging required varies with tube size and other design considerations. Generally, the wedging required is of the order of approximately 1 to 3 mm. In another embodiment, it has been found desirable to include a faceplate panel which is thicker at its corners than at the ends of its major and minor axes.

The curvature of the shadow mask 24 somewhat parallels the curvature of the interior surface of the faceplate 18. However, one deviation from such parallel relationship is well known in the art, e.g., from U.S. Pat. No. 4,136,300, issued to A. M. Morrell on Jan. 23, 1979. The mask deviations of the Morrell patent, as well as the aperture spacing variations taught therein, can be applied to the present novel tube structure.

Figure 7:
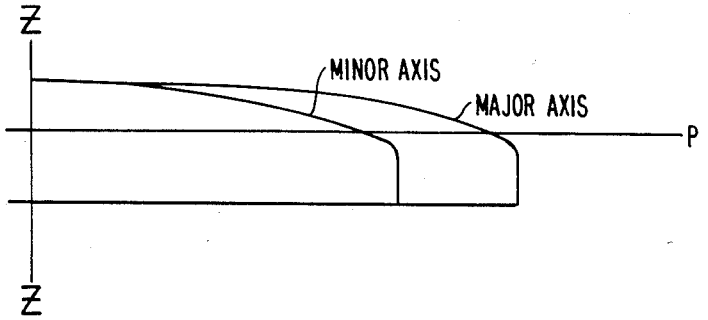
FIG. 7 is a compound view showing the exterior surface contours of a faceplate panel of another tube embodiment.

The faceplate surface curvature variation of another novel CRT is shown in FIG. 7. In this embodiment, the curvature along the minor axis is similar to that of the embodiment of FIG. 6. However, the curvature along the major axis, within the border of the screen is much less in the central portion of the faceplate and increases near the edges of the faceplate. In this embodiment, the curvature along the major axis, near the edges of the faceplate, is greater than the general curvature along the minor axis. With this design, the central portion of the faceplate becomes flatter, while the points of the faceplate exterior surface at the edges of the screen substantially remain in a plane P and define a rectangular contour line, as in the previously described embodiment.

The corresponding shadow mask for the CRT faceplate panel of FIG. 7 is somewhat similar in contour to the panel. The contour of such a shadow mask can be generally obtained by describing the major (X) axis curvature as a large radius circle over about the central 75% portion of the major axis, and a smaller radius circle over the remainder of the major axis. The curvature parallel to the minor (Y) axis is such as to smoothly fit the major axis curvature to the required mask periphery and can include a curvature variation as is used along the major axis.

Figure 8:
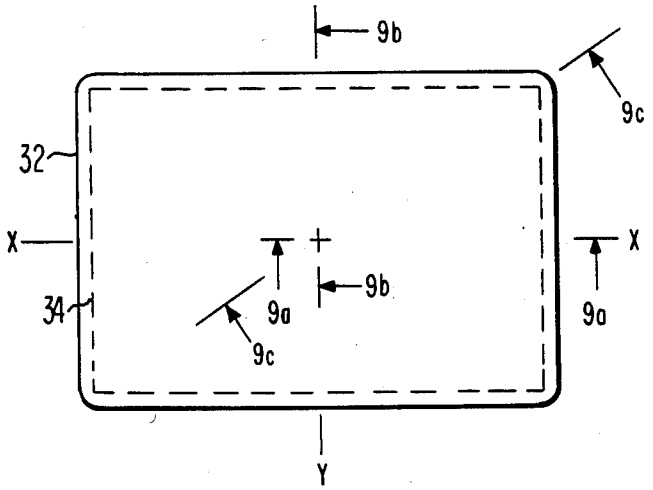
FIG. 8 is a plan view of a shadow mask that may be used with the faceplate panel of FIG. 7.
Figure 9:
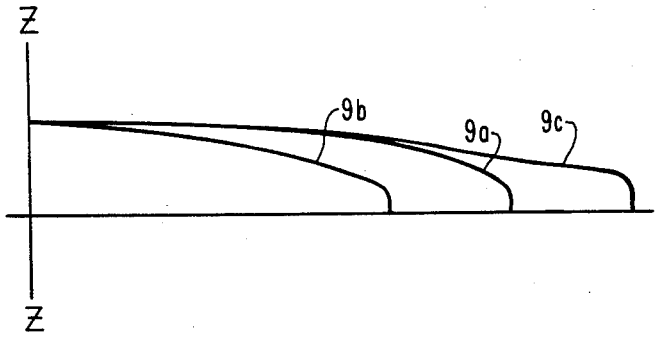
FIG. 9 is a compound view showing cross-sections of the shadow mask contours taken at lines 9*a*—9*a*, 9*b*—9*b* and 9*c*—9*c* of FIG. 8.

FIG. 8 shows a plan view of one embodiment of such a novel shadow mask 32. The dashed lines 34 show the border of the apertured portion of the mask 32. The surface contours along the major (X) and minor (Y) axes of the mask 32 are shown by the curves 9*a* and 9*b*, respectively, in FIG. 9. The mask 32 has a different curvature along its major axis than along its minor axis. The contour along the major axis has a slight curvature near the center of the mask and greater curvature at the sides of the mask. Such mask contour exhibits some improved doming characteristics because of the increased curvature near the ends of the major axis. Doming occurs when certain parts of the shadow mask become hotter than other parts and move outwardly from the general contour of the mask.

Figure 10:
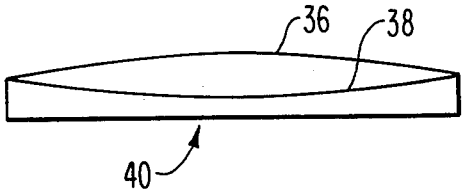
FIG. 10 is a side view of another shadow mask embodiment.

In an alternative embodiment, a shadow mask has the same curvature along both the major and minor axes in the central portion of the mask, but greater curvature at the ends of the major axis. The curvatures along the edges of the mask that parallel the major axis are less at the sides of the mask than is the curvature along the major axis, and, as shown in FIG. 10, the second derivative of the contour 36 along the minor axis is opposite in sign to that of the second derivative of the contour 38 at the sides of the mask 40 which are parallel to the minor axis.

As with the above-described faceplate panels, the contours along the shadow mask diagonals must be smoothed to compensate for the different curvatures. Such smoothing results in a center-to-corner contour along the diagonals which has at least one sign change in its second derivative, such as contour 9*c* in FIG. 9.

It should be appreciated that the present invention is applicable to a wide variety of CRT's, including shadow mask color picture tubes of line or dot screen types as well a monochrome picture tubes.

What is claimed is:

1. A cathode-ray tube including a rectangular faceplate wherein a long side of the faceplate substantially parallels a major axis of the tube and a short side of the faceplate substantially parallels a minor axis of the tube, said faceplate having an exterior surface having curvature along both said minor and major axes and wherein said exterior surface includes a substantially rectangular contour near the periphery of said faceplate which substantially lies in a plane that is perpendicular to the central longitudinal axis of said tube and wherein the equation of the line formed by the center-to-corner contour of the cross-section of said exterior surface has at least one sign change of its second derivative.

* * * * *